United States Patent [19]

Craig

[11] Patent Number: 4,705,326

[45] Date of Patent: Nov. 10, 1987

[54] LOCKING SYSTEM

[75] Inventor: Clark E. Craig, Simpsonville, S.C.

[73] Assignee: Valhi, Inc., Dallas, Tex.

[21] Appl. No.: 898,094

[22] Filed: Aug. 20, 1986

Related U.S. Application Data

[63] Continuation-in-part of Ser. No. 768,157, Aug. 22, 1985, Pat. No. 4,684,178.

[51] Int. Cl.[4] ..... E05C 7/06

[52] U.S. Cl. ..... 312/221; 312/216

[58] Field of Search ..... 312/216, 217, 220, 221, 312/218, 219, 107.5, 310, 222

[56] References Cited

U.S. PATENT DOCUMENTS

| | | | |
|---|---|---|---|
| 1,943,099 | 1/1934 | Tobey | 312/219 |
| 2,842,419 | 7/1958 | Howard | 312/218 |
| 3,874,755 | 4/1975 | Hegg et al. | 312/221 |
| 3,881,793 | 5/1975 | Anderson | 312/217 |
| 4,452,498 | 6/1984 | Wood et al. | 312/220 |

FOREIGN PATENT DOCUMENTS

| | | | |
|---|---|---|---|
| 2133213 | 1/1973 | Fed. Rep. of Germany | 312/216 R |

*Primary Examiner*—Kenneth J. Dorner
*Assistant Examiner*—Gerald A. Anderson
*Attorney, Agent, or Firm*—Allegretti, Newitt, Witcoff & McAndrews, Ltd.

[57] ABSTRACT

An improved locking system for a series of vertical arrayed drawers includes a plurality of dogs mounted on a pivot rod attached to a panel adjacent the series of drawers. The dogs pivot in response to an actuator plate which is driven by cam drive associated with movement of the drawers. The mechanism is useful for operation of a series of drawers in vertical array to maintain all of the drawers closed or to maintain selected drawers in a closed condition.

8 Claims, 9 Drawing Figures

150
152
154
156
158
160
162
164
166
170
172
174
176
178
180
182
184
186
188
190
191
192

LOCKING SYSTEM

CROSS REFERENCE TO RELATED APPLICATION

This is a continuation-in-part application to Ser. No. 768,157, filed Aug. 22, 1985, now U.S. Pat. No. 4,684,178 which is incorporated herewith by reference.

BACKGROUND OF THE INVENTION

This invention relates to an improved locking system mechanism and more particularly to a system of the type wherein a series of vertical drawers may be simultaneously locked or unlocked, and wherein opening of one drawer prevents opening of other drawers in the vertical array of drawers.

A drawer locking system for a desk and/or a credenza may employ a single lock for locking a series of vertically arrayed drawers. In this manner, operation of a single key in the lock of one of the drawers will automatically lock the remainder of the drawers. For example, the drawer lock may comprise a depending, vertically slidable, locking bar having a series of locking pins projecting laterally therefrom for engagement respectively with a detent associated with each one in the series of drawers. Rotation of the key in the single lock will drive the locking bar vertically and will simultaneously position the locking bar pins into or out of locking position with the drawer detents.

Other types of such locking systems are available. Usually, however, prior art systems require the installation of rather complex linkage mechanisms connecting the component parts of the system. Thus, there has been a need for a simplified mechanism which will effect locking of drawers by operation of a single lock. Such a system should be easily installed, have the fewest number of parts necessary, should be reliable and inexpensive, and should interconnect a series of vertically arrayed drawers.

SUMMARY OF THE INVENTION

Briefly, the present invention comprises an improved multiple drawer locking system wherein a cam drive member is attached to a side of one drawer. Sliding movement of the drawer projects the cam drive member into engagement with a bracket or actuator plate mounted on a pivot rod supported vertically on a side panel of the case for the drawers. The rod pivots when the bracket is engaged by the cam drive member. Stop members or dogs are also attached to the rod, mounted for pivotal movement with the pivot rod. Thus, movement of the one drawer causes cam drive member to engage the bracket and simultaneously pivot the pivot rod and attached stop members or dogs. The dogs, when so pivoted, engage ribs on the remaining drawers and lock those drawers in a closed position. Alternatively, a bolt may be actuated to strike the bracket and thereby effect pivotal movement of the rod and locking operation of the dogs.

As a consequence of the construction of the invention, it is possible to lock every one of a series of vertically arranged drawers in the closed position or to lock all except one of the drawers in the closed position. The apparatus thus has application as a locking system for a series of vertical drawers and as an anti-tilt mechanism which ensures that only a single drawer in a vertical file will be opened at any one time.

Thus, it is an object of the invention to provide an improved multiple drawer locking system.

It is a further object of the invention to provide an improved multiple drawer locking system utilizing a minimum number of parts.

Still a further object of the invention is to provide a drawer locking system which eliminates long and complex mechanical linkages for connecting a lock associated with a control drawer or door to a side bar locking system.

Yet another object of the invention is to provide an easily installed and economical drawer locking system for desks and the like.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figures 1, 2:
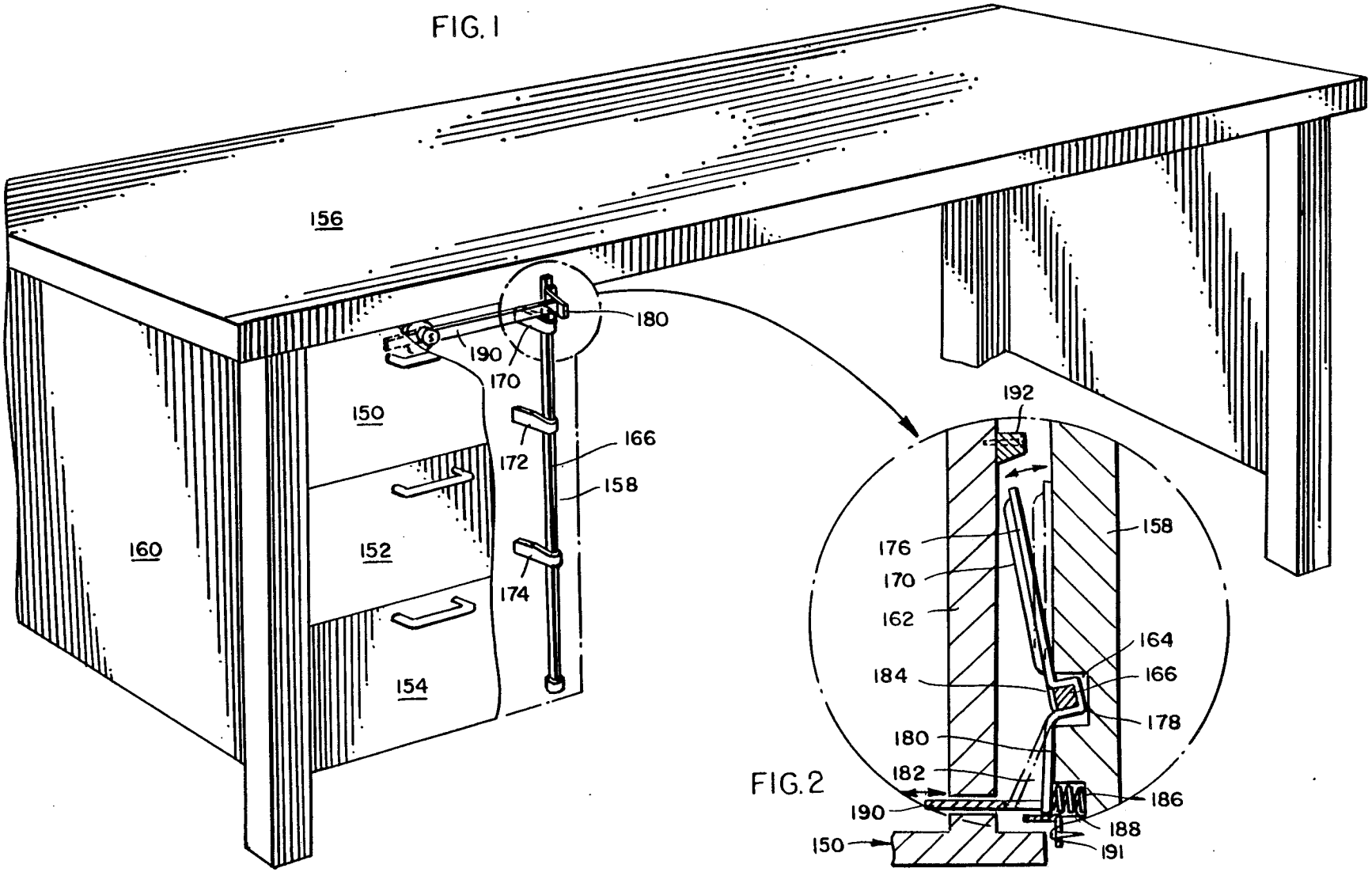
FIG. 1 is a cutaway perspective view incorporating the locking system of the present invention for a series of vertically arranged drawers.
FIG. 2 is an enlarged top plan view of the locking system of the invention.

FIGS. 1 and 2 illustrate a first embodiment of the invention. Referring to these figures, a typical desk 156 may include a series of horizontal drawers 150, 152 and 154 incorporated in a vertical stack or array one above the other. The drawers 150, 152, 154 are supported in the desk 156 between parallel, vertical side support panels 158 and 160. Hardware known to those skilled in the art is provided for mounting the sides of the drawers 150, 152, 154 to the side panels 158, 160 for sliding movement of the separate drawers 150, 152, 154 into and out of the compartment formed by the panels 158, 160. Thus, each drawer 150, 152, 154 includes a drawer side 162 as shown in FIG. 2 with slide hardware for horizontal sliding support by panel 158.

The panel 158 includes an inside vertical slot 164 that extends the length of the panel 158 adjacent all of the drawers 150, 152, 154. Positioned within the slot 164 is a generally vertical pivot rod 166 maintained so that it can pivot about its vertical axis. At selected positions along the rod 166 adjacent respective drawers 150, 152, 154, projecting dogs or stop members 170, 172 and 174, respectively, are positioned. The dogs or stop members 170, 172, 174 each comprise a horizontal, rearwardly projecting flange 176 from a hub 178 which is affixed to the pivot rod 164. Importantly, the flange 176 of each dog 170, 172, 174 extends toward the rear of the drawers 150, 152, 154.

A separate bracket or actuator plate 180 is also affixed to the rod 166. The actuator plate 180 includes a forwardly projecting flange 182 extending from a hub 184 which is affixed to the pivot rod 166. Actuator plate 180 thus pivots with the rod 166. In sum, as the rod 166 pivots, so do the flanges 176 of dogs 170, 172, 174 and the flange 182 of plate 180. The flange 182 of plate 180 forms an obtuse angle with respect to the flange 176 of dog 170. The angular relationship between the flanges 176 and 182 in the preferred embodiment is approximately 145°.

Flange 182 is normally biased outwardly away from the panel 158 by a spring 186 which fits into a counterbore or recess 188 in panel 158. The spring 186 contacts the flange 182 biasing that flange 182 in the clockwise direction as shown in FIG. 2. This effectively biases the pivot rod 166 as well as the attached dogs or stop members 170, 172, 174 uniformly and simultaneously in the clockwise direction. Consequently, when the drawer 150 is in the closed position, the dog 170 adjacent drawer 150 fits or is biased flush against the panel 158.

A key operated lock bolt 190 is slidably mounted on the front panel of drawer 150 transverse to the flange 182 of plate 180. When bolt 190 is actuated or thrown against the flange 182 as depicted in FIG. 2, the bolt 190 moves the flange 182 against the force of the spring 186. This causes the flange 182 and rod 166 to pivot in the counterclockwise direction. Consequently, the stop members or dogs 170, 172, 174 pivot in the counterclockwise direction into the path of the respective rib members 192 attached to the side 162 of each drawer 150, 152, 154. The rib members 192 are positioned on the side 162 so as to coact with the appropriate stop member or dog 170, 172, 174 thereby preventing sliding movement of the associated drawers 150, 152, 154 in the vertical stack of drawers. Thus, stop members or dogs 170, 172, 174 are provided at selected positions along the pivot rod 166 to cooperatively engage associated rib members 192 of each drawer 150, 152, 154. An optional strike 191 may be attached to the inside of panel 158 for cooperation with bolt 190 to further lock drawer 150 in the closed position as depicted in FIG. 2. That is, strike 191 projects transversely from panel 158 into the path of bolt 190 when in the locked position.

Conversely, disengagement of the bolt 190 from the flange 182 permits the stop members 170, 172, 174 to return to their flush position against the panel 158 in response to the biasing force of spring 186. The drawers 150, 152, 154 can then be opened in such a circumstance.

Figure 3:
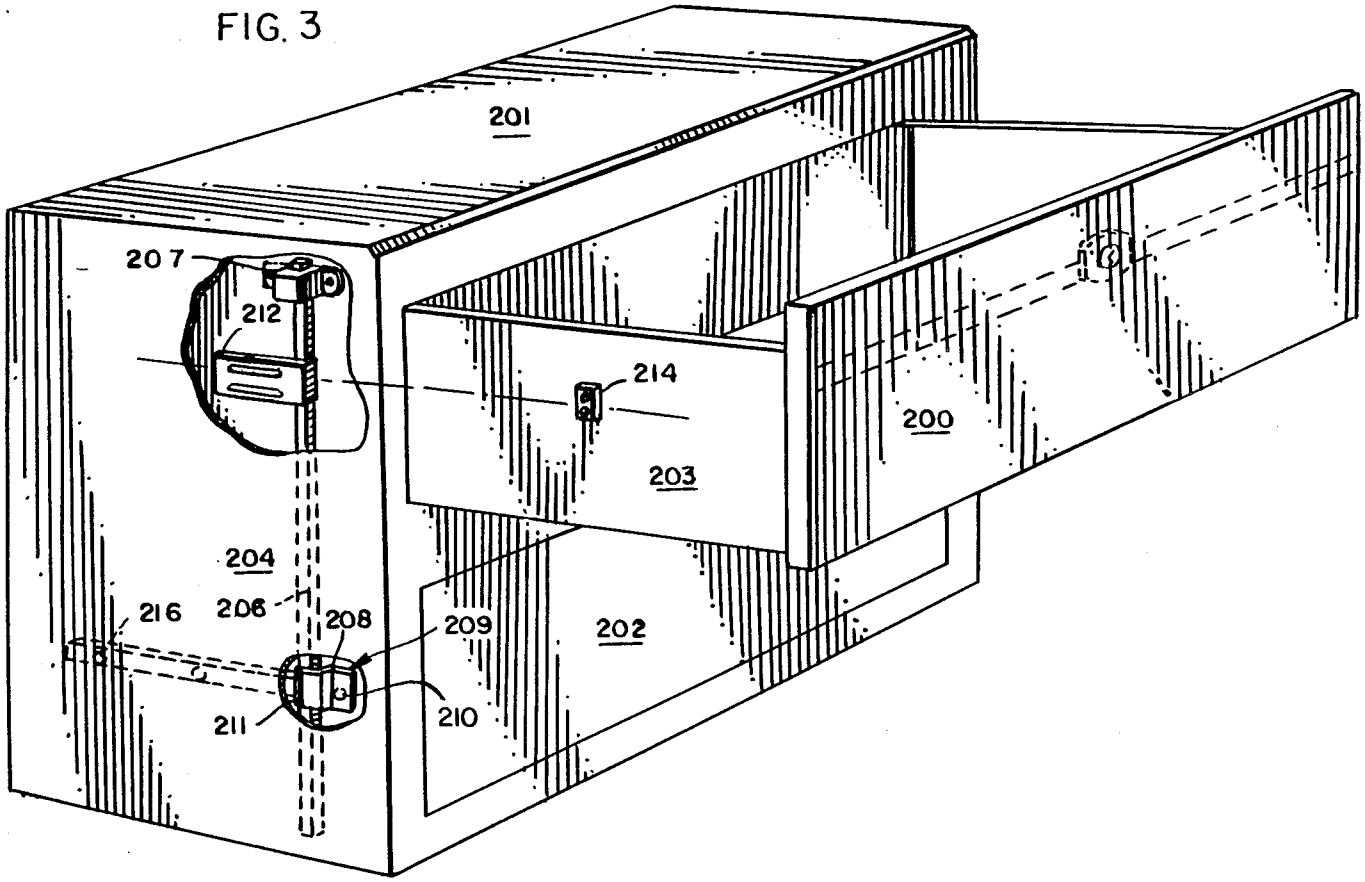
FIG. 3 is a cutaway perspective view of an alternative embodiment of the invention incorporated in an anti-tilt system for lateral files.

FIG. 3 illustrates an anti-tilt system incorporating the general construction previously described. Referring to FIG. 3, first and second drawers 200 and 202 are mounted vertically one above the other. A side panel 204 associated with the case 201 for the drawers 200 and 202 includes a vertical pivot rod 206 mounted in a slot 207 on the inside surface of panel 204. An actuator plate 209 or bracket includes a hub 211 attached to rod 206 and a flange 208 projecting therefrom and pivotal therewith. A spring 210 is compressed between the flange 208 and panel 204. The flange 208 is foreshortened relative to the space between the panel 204 and side wall 203 of drawers 200 and 202 so that the flange 208 will not interfere with the slide hardware on the side walls 203 of the drawers 200, 202.

When the rod 206 is biased in the manner shown, an elongated stop member or dog 212 attached to the rod 206 is maintained flush against the inside surface of the panel 203 so that it will not engage a rib member 214 on drawer 200. However, when the upper drawer 200 is closed and the lower drawer 202 is opened, a horizontal rail 216 mounted on the side wall 203 of drawer 202 will engage the flange 208 pivoting that flange 208 in a clockwise direction as viewed from the top. This will cause the rod 206 to pivot which will also cause the stop member or dog 212 to pivot toward the side wall 203 of the drawer 200. Stop member or dog 212 is then in position to engage against the rib 214. The engagement of the stop member or dog 212 with the rib 214 prevents opening of the upper drawer 200 when the lower drawer 202 is open.

Figure 4:
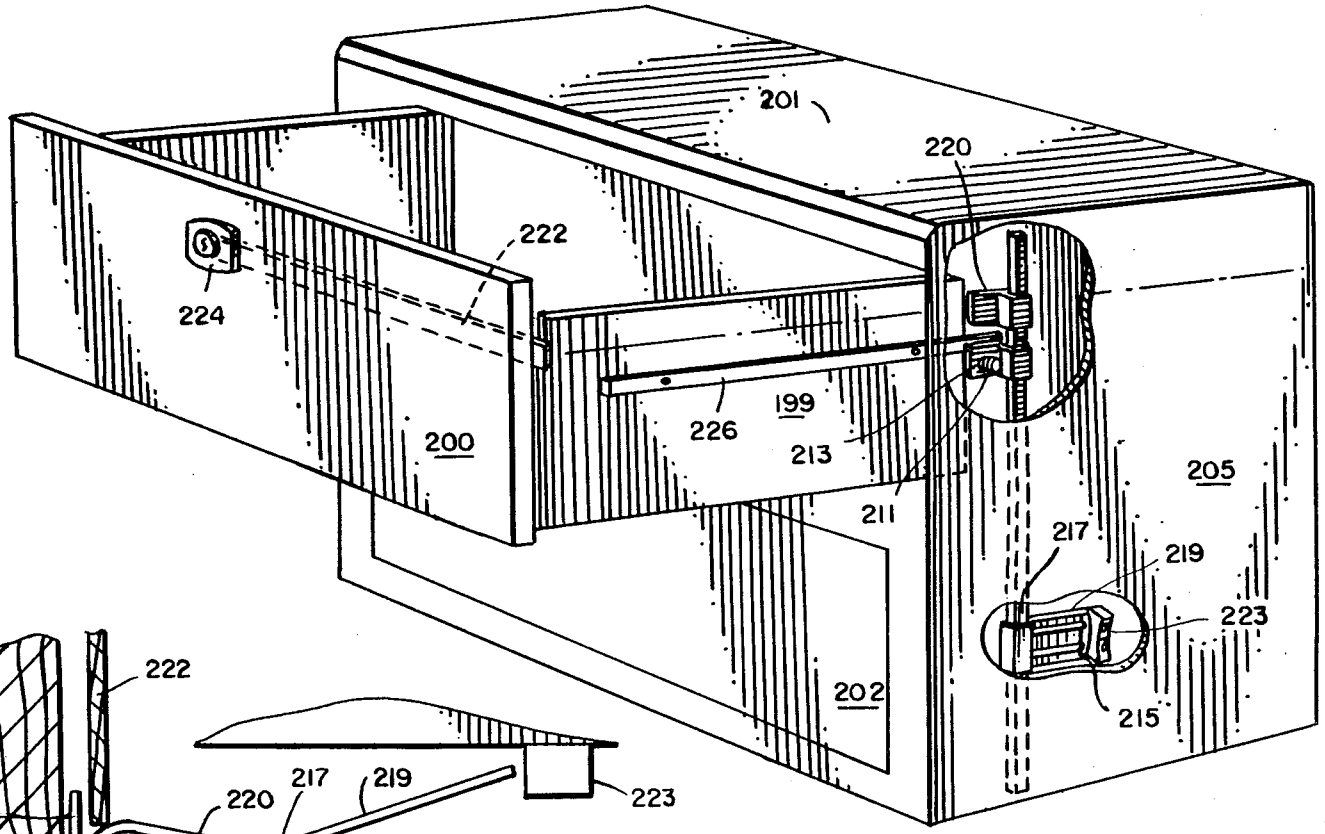
FIG. 4 is a cutaway perspective view illustrating the opposite side of the lateral file construction of FIG. 3.

FIG. 4 illustrates the arrangement of the drawers and associated hardware system of FIG. 3 on the opposite side panel 205 of case 201 and side wall 199 of the drawer 200 as well as side wall 215 of drawer 202. Here a pivot rod 217 mounted in a slot on the inside surface of panel 205 has a rearwardly extended stop member or dog 219 adapted for cooperation with a rib member 223 attached to side wall 215. Specifically, side wall 215 of lower drawer 202 includes a projecting rib member 223 which can cooperate with the stop member or dog 219 when the dog 219 is properly positioned.

A forwardly extending actuator plate 213 biased by a spring 211 outwardly from panel 205 is positioned on the rod 217 for cooperation with the top drawer 200. An additional, forwardly extending secondary, short actuator plate 220 is also affixed to the pivot rod 217 above the actuator plate 213. Secondary actuator plate 220 is in horizontal alignment with a slidable lock bolt 222.

The slidable lock bolt 222 is affixed to the front panel of drawer 200 and slides horizontally in response to a key operation of lock 224 provided in the top drawer 200. Bolt 222 cooperates with secondary actuator plate 220.

In operation, if the top drawer 200 is unlocked and opened (i.e., the bolt 222 is slidably positioned to the left so that drawer 200 may be opened), then a horizontal rail 226 on the side wall 199 of drawer 200 will engage the actuator plate 213 causing the rod 217 to pivot thereby positioning the stop member or dog 219 associated with lower drawer 202 to engage rib member 223 attached to side panel 215. This prevents opening of the bottom drawer 202 when the top drawer is previously opened, i.e. the reverse situation relative to the description of FIG. 3.

If both drawers 200, 202 are closed, then either drawer 200, 202 may be singly opened since the rail 226 does not extend totally to the front panel of drawer 200 and thus does not engage plate 213. This permits the actuator plate 213 to be pivoted clockwise when viewed from the top in response to the force of spring 211. Either drawer 200, 202 is therefore free to open.

As previously described, however, if the bottom drawer 202 is opened, then the top drawer 200 cannot open. Again, if the top drawer 200 is open, then the bottom drawer 202 cannot be opened.

Figure 4A:
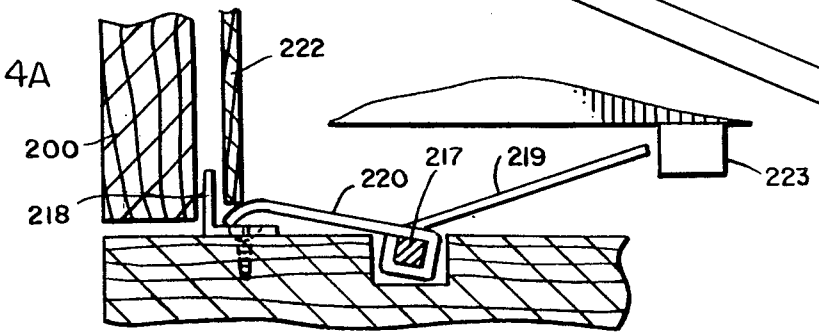
FIG. 4A is a partial cross sectional view of the top drawer of the lateral file of FIG. 4.

Further, if both drawers 200, 202 are closed and the lock bolt 222 is moved to the right in FIGS. 4 and 4A to engage the secondary actuator plate 220, then both drawers 200 and 202 are locked. That is, lock bolt 222 effectively locks the top drawer 200 by engaging a strike 218 projecting from the inside of panel 205 and the bottom drawer 202 is locked by coaction by the stop member or dog 219 with the rib member 223 since the bolt 222 engages the secondary actuator plate 220 to thereby pivot the rod 207 and dog 219 to the locking position.

Figure 5:
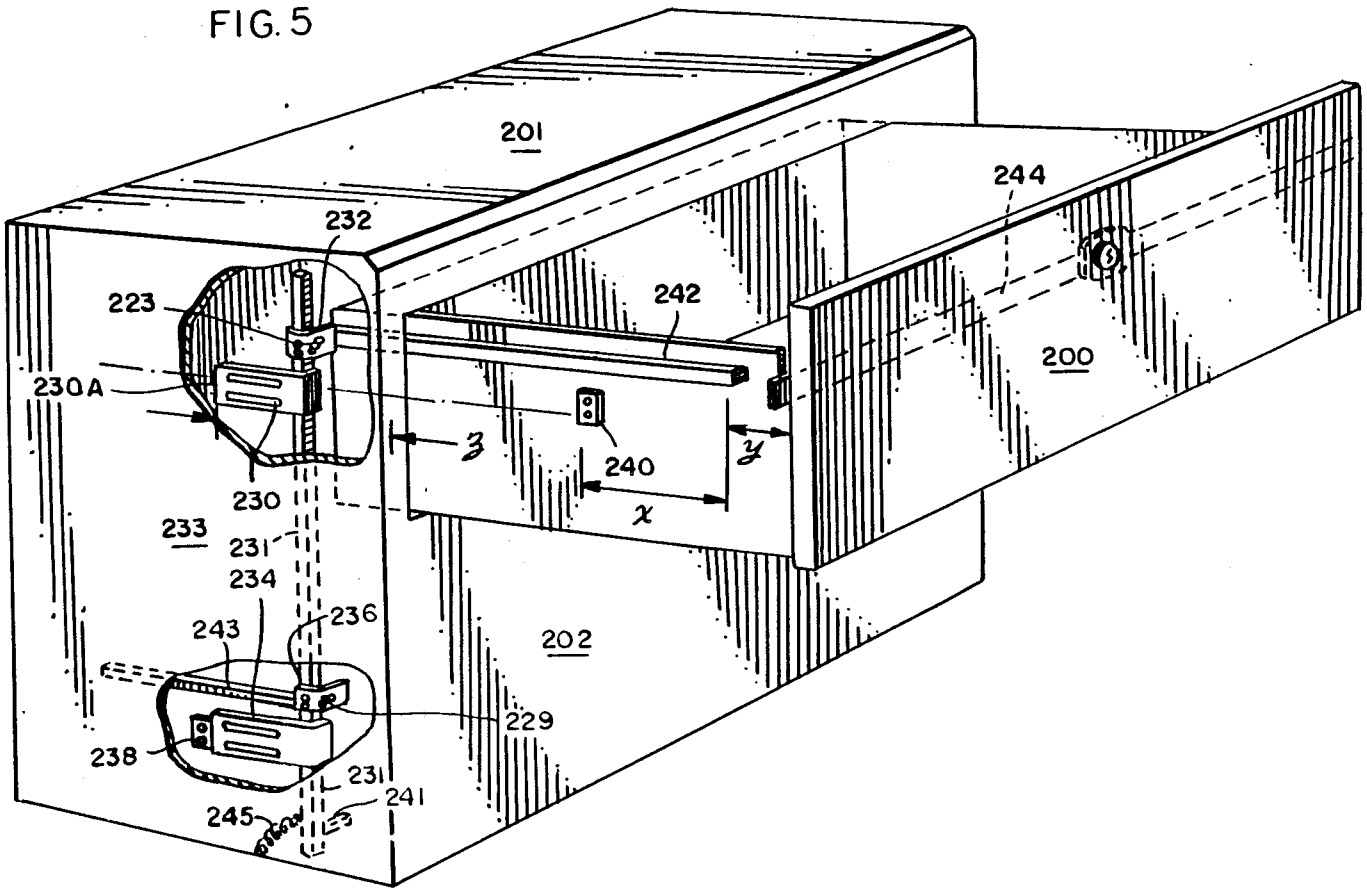
FIG. 5 is another cutaway perspective view illustrating a further variation of the locking system of the invention.

FIG. 5 illustrates another embodiment of the invention wherein both a stop member or dog 230, 234 as well as a spring biased actuator plate 232, 236 are provided respectively for each drawer 200, 202 on the same side of the drawers 200, 202. Thus, the upper drawer 200 coacts with a first stop member or dog 230 and a first actuator plate 232 both mounted on a vertical pivot rod 231 on the inside of side panel 233. The lower drawer 202 likewise includes an associated stop member or dog 234 and a spring biased actuator plate 236 both mounted on pivot rod 231. The stop member or dog 234 cooperates with a rib member 238 attached to the side of drawer 202. The stop member or dog 230 cooperates with a rib member 240 attached to the side of drawer 200.

A horizontal rail 242 attached to the side of top drawer 200 is cooperative with actuator plate 232 biased by a spring 228 in order to effect pivoting action of rod 231 and locking of the lower drawer 202. A similar rail 243 is provided on the side panel of lower drawer 202 adjacent actuator plate 236. A single, sliding lock bolt 244, mounted in the front panel of drawer 200, is provided to engage the actuator plate 232 and thereby lock the entire system if both drawers 200, 202 are closed.

Figure 6:
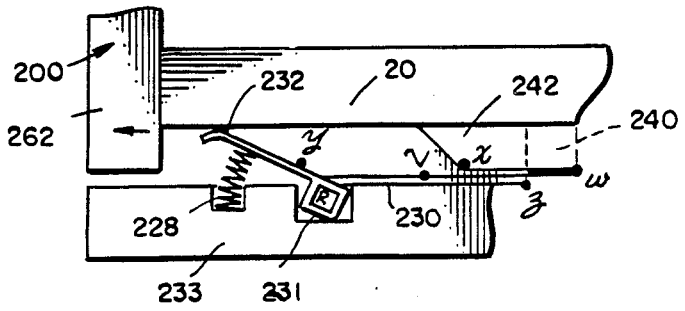
FIG. 6 is a partial top plan view of the construction of FIG. 5 with the drawers in a closed position.
Figure 7:
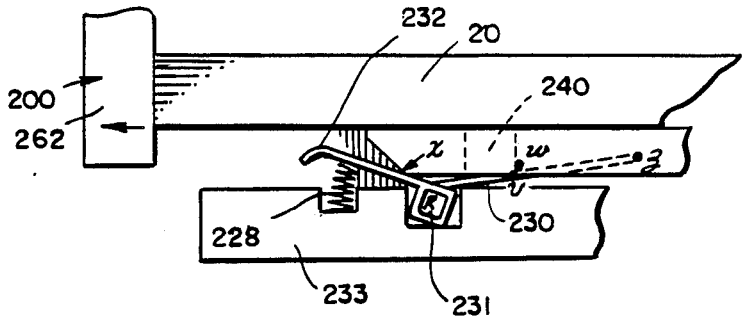
FIG. 7 is a top plan view similar to FIG. 6 showing a drawer partially opened.
Figure 8:
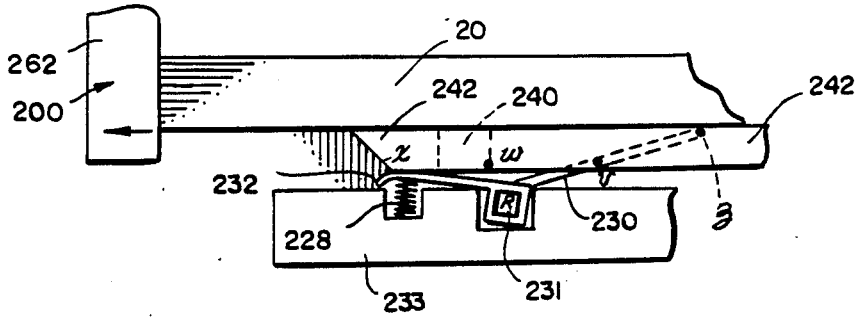
FIG. 8 is a top plan view similar to FIG. 7 showing the drawer further opened.

As depicted in FIGS. 6–8, with respect to top drawer 200, the position and length of the ribs 238, 240 and the rails 242, 243 are very important. Thus, the rails 242, 243 each extend toward the front of the associated drawers 200, 202. However, each rail 242, 243 is foreshortened, i.e. does not extend entirely to the front of its associated drawer. This permits the actuator plates 232, 236 to be biased into the gap between the forward end of the rails 242, 243 and the front panel 260, 262 of each drawer 200, 202 when the drawers 200, 202 are closed. Thus, if the drawers are not locked, either drawer 200, 202 may be opened. This results since the plates 232, 236 are biased to a position which requires that the dogs 230, 234 be positioned flush against the side panels of the drawer case and out of engagement with rib members 238, 240. In one embodiment springs 228, 229 are associated respectively with actuator plates 232, 236 to pivot the rod 231 and thus pivot the stop members 230, 234 flush against the inside surface of panel 233 so that either drawer 200, 202 can be opened.

After one of the drawers, e.g. drawer 200, is opened partially, the rail 242 will be moved horizontally forward to engage the actuator plate 232 thereby pivoting rod 231 and both stop members or dogs 230, 234. Simultaneously, of course, the lower drawer is locked in a closed position because of the engagement of stop member 234 and rib 238. The rail 243 and rib 238 are similarly dimensioned and positioned to permit opening of the bottom drawer 202 while locking the top drawer 200.

Thus referring to FIG. 6, points X and W are located on the rail 242 and rib 240 respectively and move with the drawer 200. Points Y and Z are located on the plate 232 and dog 230 respectively and pivot about rod 231 mounted in panel 233. With the drawer 200 fully closed, the distance, X to Y, approximates the distance W to V. This is to insure that the edge W of rib 240 is pulled beyond the edge Z of dog 230 to point V before point X of rail 242 contacts point Y of plate 232, preventing drawer 200 from being locked by point Z of dog 230 engaging the rib 242.

Referring next to FIG. 7, as drawer 200 is pulled, point W moves beyond point Z to point V, as point X lines up with point Y. By the time point X of rail 242 engages the short plate 232 at point Y, the rib 242 is far enough beyond the point Z of dog 230 to allow further pivoting of rod 231.

Finally referring to FIG. 8, as drawer 200 is further extended, the rail 242 fully depresses the short plate 232 pivoting rod 231 maximally and locking all drawers 202 remaining in their retracted positions, through the action of point Z on the associated dog 234 engaging their respective ribs 243. At this juncture the object drawer 200 may be fully extended.

Referring again to FIG. 5, the rod 231 may be cooperative with a detent mechanism or alternatively the actuator plates 232, 236 have a spring biasing mechanism as described. FIG. 5 thus depicts two spring or biasing mechanisms either one of which may be used in the embodiment. When using a detent mechanism, for example, an arm 241 may extend from the rod 231. A coil spring 245 attached between the end of the arm 241 and a point behind the rod 231 will serve as an overcenter acting mechansim or detent mechanism for rod 231. Thus, the rod 231 (as well as attached plates and dogs) will be biased to a first position or a second position depending upon the reaction of the stop members or dogs 230, 234, or actuator plates 232, 236 with associated rib members 238, 240 or rails 242, 243. Other detent mechanisms may be utilized for biasing the rod 231 to the first or second position.

In review, FIGS. 3 and 4 depict an arrangement wherein pivot rods and component parts are situated on opposite sides of an array of drawers stacked vertically in a case to provide an anti-tilt system. FIG. 5 illustrates a system wherein the component parts are all positioned on one side of a drawer case and thus operated by a single pivot rod 231.

While there has been set forth a preferred embodiment of the invention, it is to be understood that the invention is to be limited only by the following claims and their equivalents.

What is claimed is:

1. An improved locking system for a vertical array of drawers, said drawers having side walls, said drawers each slidably mounted in a drawer cabinet having at least one cabinet side wall, said system comprising, in combination:

a rib member projecting from a side wall of each drawer;

a generally vertical pivot rod on said cabinet side wall extending adjacent the drawer side walls;

at least one dog laterally extending from the rod adjacent each drawer side wall and pivotal with the rod between a first position of non-engagement with a drawer rib and a second position of engagement with a drawer rib;

biasing means for pivotally biasing the rod and dogs toward the first position; and means mounted on at least one drawer for continuously pivoting the rod and stop members toward the second position when said one drawer is open, said means comprising a horizontal rail on a side wall of said one drawer for engaging the rod and cooperative means on the rod continuously only when the one drawer is at least partially open whereby the rod is biased to the first position whenever the drawers are fully closed.

2. The system of claim 1 wherein the means mounted on a drawer comprise a key actuated bolt member slidable between a locked and unlocked position and operative to counteract the biasing means and pivot the rod as well as the dogs into the locked position.

3. The system of claim 1 wherein the cooperative means comprises a cantilever member attached to the rod and the biasing means comprises spring means acting on the cantilever member.

4. An improved locking system for a vertical array of drawers, said drawers each separately slidable in a drawer cabinet of the type having at least one cabinet side wall, said system including means for locking at least one drawer in a closed position in the cabinet whenever another drawer is open in order to prevent the drawer cabinet from tilting; said system comprising, in combination:

a generally vertical pivot rod on said cabinet side wall extending adjacent the drawers;

at least one dog laterally extending from the rod adjacent one drawer and pivotal with the rod between a first position engaging the one drawer and a second position disengaging the one drawer;

at least one actuator plate laterally extending from and fixed to the rod adjacent a different drawer, said plate also pivotal with the rod, said actuator plate projecting laterally in a generally opposite direction from the pivot rod relative to the dog;

means for biasing the rod and attached dog and plate toward the second position;

rail means on said different drawer for continuously engaging the actuator plate to pivot the rod and move the dog to the first position and maintain the dog in the first position whenever the different drawer is at least partially opened, whereby only one drawer may be opened at any given time.

5. The system of claim 4 wherein the means for biasing comprise spring means acting on the actuator plate.

6. The system of claim 4 wherein said means for engaging the bracket member comprise a horizontal rail attached to the drawer and extending partially along the side of the drawer.

7. The system of claim 4 in combination with lock means, said lock means mounted on a drawer and including bolt means engageable with the actuator plate to thereby pivot the dog into a locked position when the drawer is closed.

8. The system of claim 4 including an actuator plate and an associated dog for each drawer, whereby as one actuator plate for one opened drawer is pivoted, all the dogs for the other drawers are pivoted to the drawer locked and closed first position.

* * * * *